US008483400B2

(12) United States Patent
Schreuder et al.

(10) Patent No.: US 8,483,400 B2
(45) **Date of Patent: *Jul. 9, 2013**

(54) SMALL STEREO HEADSET HAVING SEPERATE CONTROL BOX AND WIRELESS CONNECTABILITY TO AUDIO SOURCE

(75) Inventors: Johannes Lucas Schreuder, EeS (NL); Jan-Willem Zweers, Nieuwleusen (NL)

(73) Assignee: Plantronics, Inc., Santa Cruz, CA (US)

( * ) Notice: Subject to any disclaimer, the term of this patent is extended or adjusted under 35 U.S.C. 154(b) by 278 days.

This patent is subject to a terminal disclaimer.

(21) Appl. No.: 12/906,968

(22) Filed: Oct. 18, 2010

(65) Prior Publication Data

US 2011/0317844 A1 Dec. 29, 2011

Related U.S. Application Data

(60) Provisional application No. 61/358,473, filed on Jun. 25, 2010.

(51) Int. Cl.
*H04R 1/10* (2006.01)
*G10K 11/16* (2006.01)

(52) U.S. Cl.
USPC ..... 381/74; 381/71.6

(58) Field of Classification Search
USPC ..... 381/74, 71.6
See application file for complete search history.

(56) References Cited

U.S. PATENT DOCUMENTS 5,982,904 A * 11/1999 Eghtesadi et al. ..... 381/74
6,055,312 A 4/2000 Pralus et al.
7,187,948 B2 3/2007 Alden
D630,186 S 1/2011 Yang
8,094,859 B2 * 1/2012 Suematsu et al. ..... 381/384
2001/0049262 A1 12/2001 Lehtonen
2005/0195988 A1 * 9/2005 Tashev et al. ..... 381/92
2007/0076897 A1 4/2007 Philipp
2007/0098192 A1 * 5/2007 Sipkema ..... 381/312
2007/0213783 A1 * 9/2007 Pless ..... 607/42
2007/0287380 A1 * 12/2007 Hui et al. ..... 455/41.1
2008/0311966 A1 12/2008 Klein
2008/0317105 A1 12/2008 Cohen et al.
2009/0109117 A1 * 4/2009 Johansson et al. ..... 343/876
2010/0007564 A1 * 1/2010 Hill et al. ..... 343/702
2010/0273441 A1 * 10/2010 Dubash et al. ..... 455/192.2
2011/0116675 A1 * 5/2011 Terlizzi et al. ..... 381/384
2012/0052810 A1 * 3/2012 Schreuder et al. ..... 455/41.3
2012/0087510 A1 * 4/2012 Sampimon et al. ..... 381/74
2012/0093334 A1 * 4/2012 Schreuder et al. ..... 381/74

OTHER PUBLICATIONS

PCT International Search Report, mailed Sep. 30, 2011, in connection with International Application No. PCT/NL2011/050459.
PCT Written Opinion, mailed Sep. 30, 2011, in connection with International Application No. PCT/NL2011/050459.
Motorola Bluetooth Active Headphones S9 MotoManual, Manual No. 6809507A77-0 Motorola, Inc., 2007.
Plantronics BackBeat 903/906 User Guide, 81378-03 Rev. B, Plantronics B.V., 2009.

* cited by examiner

*Primary Examiner* — Brian Ensey
*Assistant Examiner* — Katherine Faley
(74) *Attorney, Agent, or Firm* — Kenneth B. Leffler

(57) ABSTRACT

A wireless headset device has left a left ear piece, a right ear piece, a control box, and first and second cables. Each of the ear pieces comprises its own speaker and battery. The control box includes circuitry including a short-range radio transceiver, a codec, and a power management unit. The left ear piece battery is connected to supply power to the power management unit by means of the first cable; and the right ear piece battery is connected to supply power to the power management unit by means of the second cable. The power management unit in the control box regulates the supplied battery power and supplies regulated power to control box circuitry.

19 Claims, 9 Drawing Sheets

SMALL STEREO HEADSET HAVING SEPERATE CONTROL BOX AND WIRELESS CONNECTABILITY TO AUDIO SOURCE

CROSS REFERENCE TO RELATED APPLICATIONS

This application claims the benefit of U.S. Provisional Application No. 61/358,473, filed Jun. 25, 2010, which is hereby incorporated herein by reference in its entirety.

BACKGROUND

The present invention relates generally to electronic devices, such as electronic devices for engaging in voice communications and music listening. More particularly, the invention relates to a wireless headset with increased wearing comfort.

Mobile and/or wireless items of electronic devices are becoming increasingly popular and are in wide-spread use. In addition, the features associated with certain types of electronic devices have become increasingly diverse. To name just a few of many possible examples, electronic device functionality includes picture-taking ability, text messaging capability, Internet browsing functionality, electronic mail capability, video playback capability, audio playback capability, image display capability, and navigation capability.

Electronic devices, such as digital music players (e.g., those capable of reproducing audio output from mp3 or other format files), mobile (smart) phones, and portable Personal Computers like netbooks and laptops have become a significant part of many people's everyday experiences. To make these experiences as pleasing as possible, it is desirable that the electronic devices be easy to use. The user experience of these electronic devices is enhanced considerably by wireless headsets that allow the user to freely listen to prerecorded music, listen to FM radio stations, or to engage in voice communications without being tethered to a portable but not wearable host device like, for example, a smart phone or netbook.

Wireless voice headsets applying Bluetooth® technology are used extensively to interact with mobile phones. Car legislation on hands-free calling has been part of the success of such voice headsets. Such headsets are traditionally made to provide audio output to just one of the user's ears, making them by definition capable of providing only monophonic information. Relatively new on the market are wireless stereo headsets which can support both voice calls and stereo music listening. A few of these stereo headsets even have a built-in FM radio, which, in some embodiments, allow the user to tune to music stations without the need to communicate with the phone (or other host device). In some alternative embodiments, the FM radio is in the wireless headset, but its control circuitry (e.g., for tuning to different FM stations) is located in the phone (or other host device), with control messages being communicated via the wireless link.

The success of a wireless headset lies in its ergonomic factors, including how easy it can be handled (e.g., put on and taken off), how comfortable it is when worn, and how stylish it is perceived to be by people in the vicinity of the wearer. Other factors like audio performance, standby and play time and the convenience of recharging are also of importance. Current wireless stereo headsets do not offer form factors that make them really wearable. Improved designs are therefore desirable.

SUMMARY

It should be emphasized that the terms "comprises" and "comprising", when used in this specification, are taken to specify the presence of stated features, integers, steps or components; but the use of these terms does not preclude the presence or addition of one or more other features, integers, steps, components or groups thereof.

In accordance with one aspect of the present invention, the foregoing and other objects are achieved in a wireless headset device comprising: a first ear piece comprising a first speaker; a second ear piece comprising a second speaker; a control box comprising control box circuitry; a first cable; and a second cable. The first ear piece can be, for example, a left ear piece. The control box circuitry comprises a short-range radio transceiver, a codec, and a power management unit. The first ear piece further comprises a first battery connected to supply power to the power management unit by means of the first cable.

In some embodiments, the second ear piece further comprises a second battery connected to supply power to the power management unit by means of the second cable. In some embodiments, the batteries in the first and second ear pieces are electrically connected in parallel. In some embodiments, the control box comprises a third battery connected to supply power to at least a portion of circuitry within the wireless headset device.

In some embodiments, the control box circuitry comprises an FM radio. In some but not necessarily all of such embodiments, the first and second cables are configured to be used together as an antenna for the FM radio. For example, the combined length of the first and second cables is, in some embodiments, optimized for reception of FM radio signals at approximately 100 MHz.

In some embodiments, the control box comprises a microphone configured to supply microphone output signals to the codec. Output signals from the codec are, in some embodiments, supplied to the short-range radio transceiver, the short-range radio transceiver being configured to wirelessly communicate information contained in the codec output signals to a host device.

In some embodiments, one of the first and second cables is configured for use as an antenna for the short-range radio transceiver. For example, the length of the cable that is configured for use as the antenna for the short-range radio transceiver is, in some embodiments, optimized for transmission and reception of radio signals at 2.4 GHz.

In an aspect of some embodiments, the first cable comprises two wires coupled to convey power from the first battery to the power management unit; and the first cable comprises an additional two wires coupled to carry analog audio signals between the first speaker and the control box circuitry.

In an aspect of some embodiments, the second cable comprises two wires coupled to convey power from the second battery to the power management unit; and the second cable comprises an additional two wires coupled to carry analog audio signals between the second speaker and the control box circuitry.

In an aspect of some alternative embodiments, the first cable comprises two wires for supplying the power from the first battery to the power management unit; and the device comprises circuitry for communicating a first channel of two-channel audio information in digital form from the control box circuitry to circuitry in the first ear piece via the two wires in the first cable.

In an aspect of some alternative embodiments, the second cable comprises two wires for supplying the power from the second battery to the power management unit; and the device comprises circuitry for communicating a second channel of the two-channel audio information in digital form from the control box circuitry to circuitry in the second ear piece via the two wires in the second cable.

In some but not necessarily all embodiments in which both the left and right ear pieces receive audio information in digital form as described above, the first and second channels of the two-channel audio information are time multiplexed when communicated via the first and second cables to the respective first and second ear pieces.

In some embodiments, one or both of the first and second ear pieces includes a noise cancellation/suppression microphone; and the device comprises circuitry coupled to receive signals from said one or both of the noise cancellation/suppression microphones and is configured to cancel/suppress noise from an audio signal to be generated by one or both of the first and second speakers.

In some embodiments, the device further comprises a first microphone for generating a first microphone signal from sensed acoustic energy; a second microphone for generating a second microphone signal from sensed acoustic energy; and beamforming circuitry coupled to receive the first and second microphone signals and adapted to constructively combine components of the first and second microphone signals that are associated with a source of acoustic energy, and to destructively combine all other components of the first and second microphone signals.

BRIEF DESCRIPTION OF THE DRAWINGS

Many aspects of the invention can be better understood with reference to the following drawings. The components in the drawings are not necessarily to scale, emphasis instead being placed upon clear illustration of the principles of the present invention. Likewise, elements and features depicted in one drawing may be combined with elements and features depicted in additional drawings. Moreover, in the drawings, like reference numerals designate corresponding parts throughout the several views.

DETAILED DESCRIPTION

The various aspects of the invention will now be described in detail in connection with a number of exemplary embodiments. To facilitate an understanding of the invention, some aspects of the invention may be described in terms of sequences of actions to be performed by elements of a computer system or other hardware capable of executing programmed instructions. It will be recognized that in each of the embodiments, the various actions could be performed by specialized circuits (e.g., analog and/or discrete logic gates interconnected to perform a specialized function), by one or more processors programmed with a suitable set of instructions, or by a combination of both. The term "circuitry configured to" perform one or more described actions is used herein to refer to any such embodiment (i.e., one or more specialized circuits and/or one or more programmed processors). Moreover, the invention can additionally be considered to be embodied entirely within any form of computer readable carrier, such as solid-state memory, magnetic disk, or optical disk containing an appropriate set of computer instructions that would cause a processor to carry out the techniques described herein. Thus, the various aspects of the invention may be embodied in many different forms, and all such forms are contemplated to be within the scope of the invention. For each of the various aspects of the invention, any such form of embodiments as described above may be referred to herein as "logic configured to" perform a described action, or alternatively as "logic that" performs a described action.

In the present document, embodiments are described primarily in the context of a portable radio communications device, such as an illustrated mobile telephone. It will be appreciated, however, that the exemplary context of a mobile telephone is not the only operational environment in which aspects of the disclosed systems and methods may be used. Therefore, the techniques described in this document may be applied to any type of appropriate electronic host device, examples of which include a mobile telephone, a media player, a gaming device, a computer, a pager, a communicator, an electronic organizer, a personal digital assistant (PDA), a smart phone, a portable communication apparatus, remote display device, etc.

Figure 1:
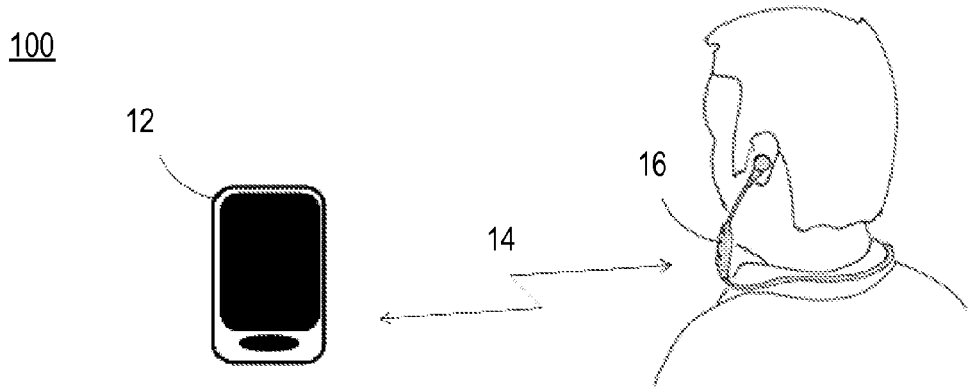
FIG. 1 is a schematic diagram of an exemplary use scenario of a particular user using a host device like a mobile phone and a wireless headset.

Electronic devices, such as mobile phones, are in widespread use throughout the world. Although the mobile phone was developed for providing wireless voice communications, its capabilities have been increased tremendously. Modern (smart) phones can access the worldwide web, store a large amount of video and music content, include a lot of applications ("apps") that enhance the phone's capabilities, provide an interface for social networking, and can even receive FM radio channels. Preferably, a phone has a large screen with touch capabilities for easy user interaction. However, having a large screen makes the phone less attractive for any interaction involving the user's ears, such as voice communications and listening to music. For those applications, the phone (or any other host device) preferably remains in a pocket or bag, and the user enjoys the applications through a small-size, wireless and wearable headset. Alternatively, the user can interact with the touch screen or buttons on the phone while simultaneously carrying on a voice call or listening to music. An example of such a user scenario 100 is shown in FIG. 1. Host device 12 is a device that contains audio content which it can stream over a wireless connection 14 to a headset 16.

Figure 2:
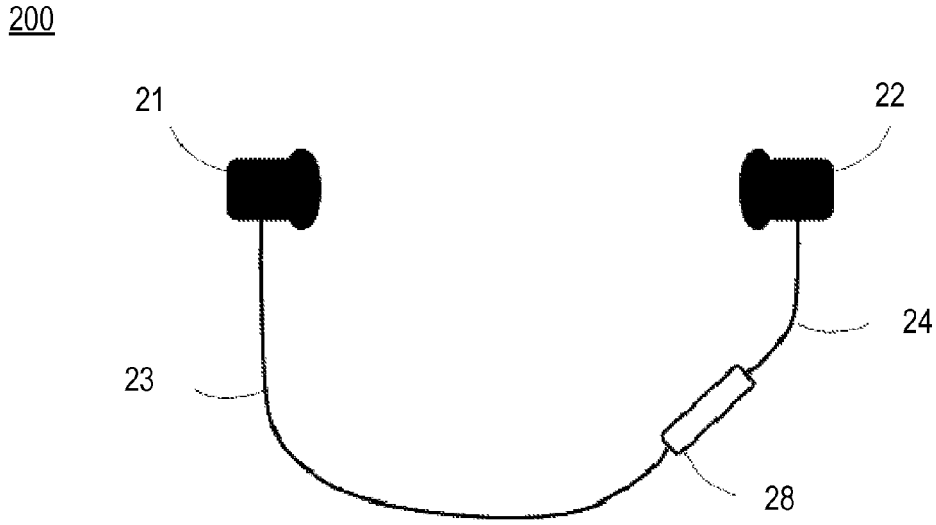
FIG. 2 is a schematic diagram of an exemplary wireless headset according to aspects of the invention.

In FIG. 2, a headset embodiment 200 is shown according aspects of the invention. The displayed headset combines a number of features that enhance the user experience:

Comfortable wearing experience (e.g., non-protruding ear pieces due to small size and balanced weight distribution so both ear pieces have about the same weight). Such comfort factors are exemplified by, but not required to be, such things as, for example, minimum alteration of the wearer's appearance (i.e., the headset is so small that, from a front view, no protrusion of the ear pieces is visible); only a thin wire coming out from the ear pieces; while resting one's head on a pillow, there is no discomfort wearing the headset.

Long standby and play time due to increased battery capacity (two batteries are used instead of one, creating the possibility of doubling playing time) while keeping a small form factor.

Acceptable FM radio reception (comparable to a wired headset connected to a mobile phone) with performance being predictable because the antenna is in a fixed position with respect to the body and the head while wearing the headset (in contrast to a wired headset in which the performance of the antenna embedded in the wire to the phone can vary considerably depending on the way of carrying the phone).

The headset comprises five individual entities: a right ear piece 21, a left ear piece 22, a control box 28, a right cable 23 connecting one or more elements within the right ear piece 21 to one or more elements within the control box 28, and a left cable 24 connecting one or more elements within the left ear piece 22 with one or more elements within the control box 28.

Figure 3:
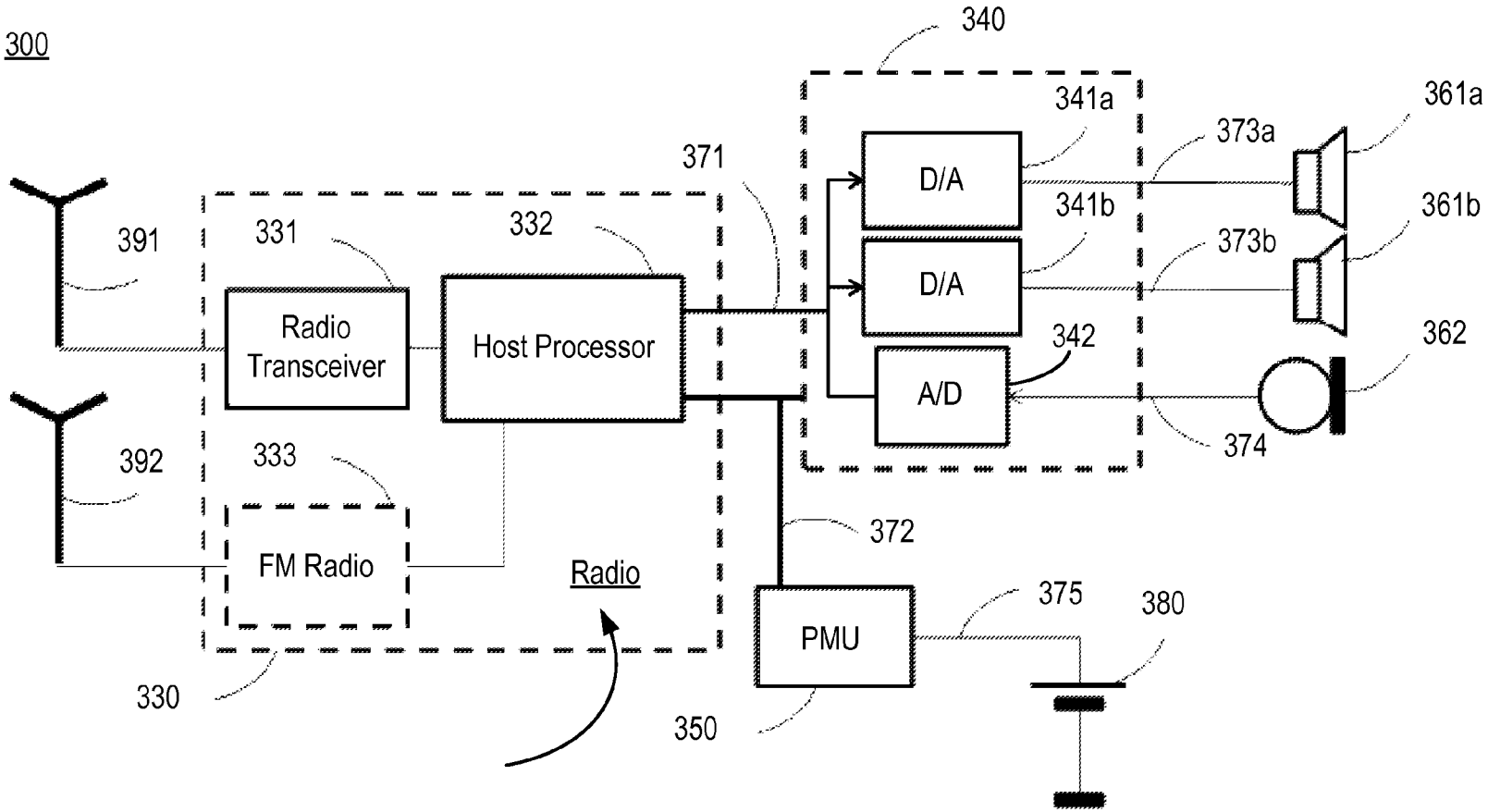
FIG. 3 is a schematic block diagram of relevant portions of an exemplary wireless headset consistent with embodiments of the invention.

FIG. 3 shows a generalized block schematic 300 of a stereo wireless headset. Wireless communication between the phone (or any other host device) and the headset is provided by an antenna 391 and a radio transceiver 331. The latter is a low-power radio covering short distances, for example a radio based on the Bluetooth® standard (operating in the 2.4 GHz ISM band). The use of a radio transceiver 331, which by definition provides two-way communication capability, allows for efficient use of air time (and consequently lower power consumption) because it enables the use of a digital modulation scheme with an automated repeat request (ARQ) protocol.

In alternative embodiments, a receive-only device for streaming audio applications (just like the FM receiver) can be used in place of the transceiver 331. In such embodiments, however, the wireless link would be less robust because no acknowledgements (ACKs) can be given when data packets are received. The use of a more robust modulation scheme (e.g., FM or FEC) can be used to compensate for this deficiency, however.

A host processor 332 controls the radio and applies audio processing (for example voice processing like echo suppression and music decoding) to the signals exchanged with the radio transceiver 331. In addition to a short-range radio transceiver 331, some but not necessarily all embodiments include an FM radio receiver 333 coupled to a second antenna 392 in order to receive FM signals (typically in the band 76-108 MHz). The radio(s) 331, 333 and host processor 332 are preferably integrated into the same (silicon) chip 330.

The digital audio signals are carried over an audio interface 371 (for example a PCM interface) between the host processor 332 and a codec 340. The codec 340 includes two Digital-to-Analog (D/A) converters 341*a*, 341*b* (for respective right and left channel information). The output of the D/A converter 341*a* connects to a right speaker 361*a*; and the output of the D/A converter 341*b* connects to a left speaker 361*b*. For embodiments that further include a voice mode (i.e., some embodiments provide audio listening capability only), the codec 340 further includes an Analog-to-Digital (A/D) converter 342 that receives an input signal from a microphone 362. As is well known in the art, a "speaker" transduces electrical signals into acoustic signals, and a "microphone" transduces acoustic signals into electrical signals. These connections are made via wires 373*a*, 373*b*, and 374, respectively. To avoid cluttering the figure, ground wires for the speaker and microphone are not shown. A Power Management Unit (PMU) 350 provides the stable voltage and current supplies for all electronic circuitry. The PMU 350 is controlled by the host processor 332 via a data interface 372 (for example an I2C interface). The data interface 372 is also used to communicate between the host processor 332 and the codec 340. Finally, all power in the device is delivered by a battery 380, which typically provides a 3.7V voltage. The supply current is carried over a wire 375 (a ground wire is not shown). The battery 380 can be a primary battery or a rechargeable battery.

Figure 4:
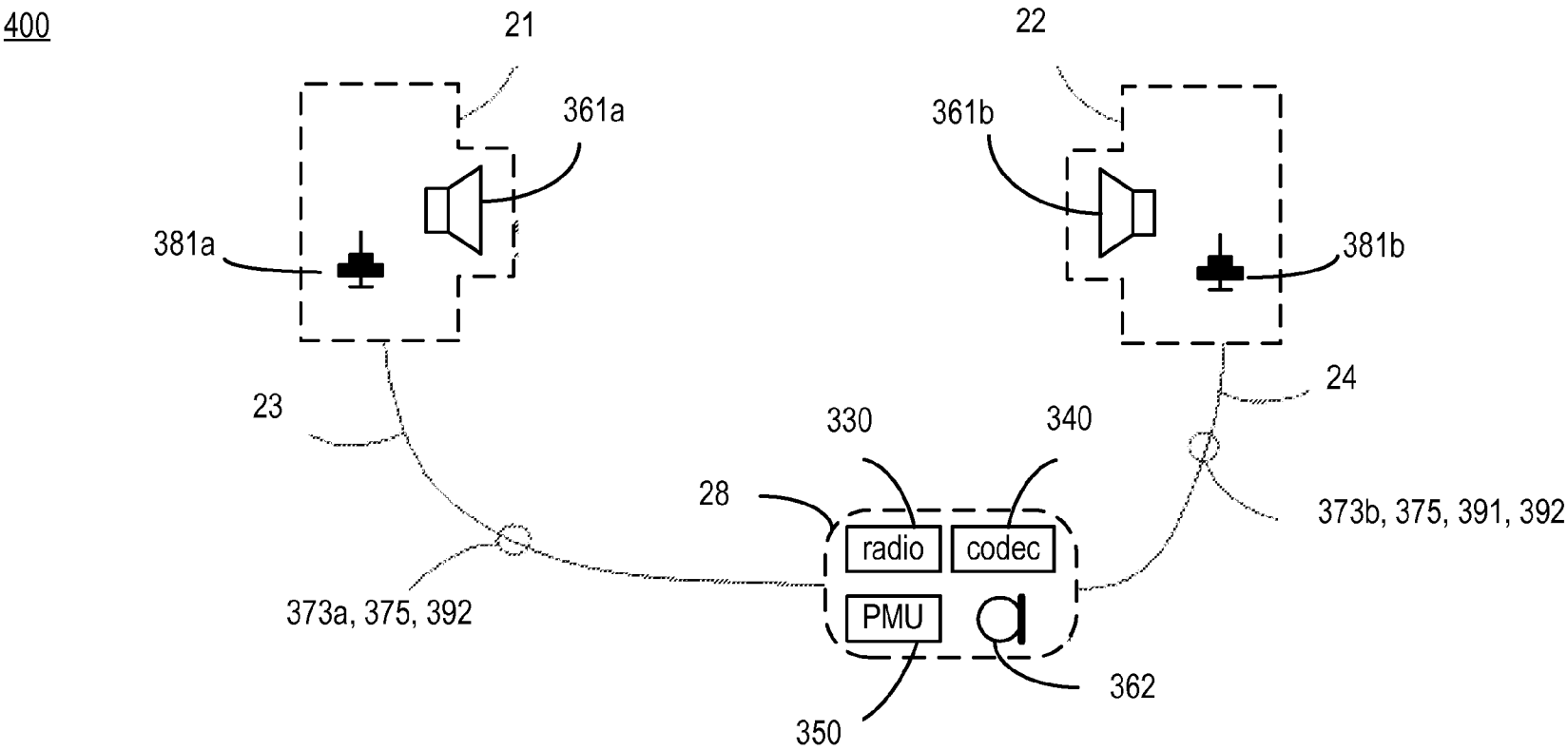
FIG. 4 is a detailed schematic diagram of a first embodiment consistent with aspects of the invention.

A first embodiment of a wireless headset 400 consistent with aspects of the invention is shown in FIG. 4. The right and left speakers 361*a* and 361*b* are located in the right and left ear pieces 21 and 22, respectively. The single battery 380 of FIG. 3 is replaced by two smaller batteries 381*a* and 381*b*, which are located in the right and left ear pieces 21 and 22, respectively. The two batteries 381*a*, 381*b* together provide the same or comparable functionality as that provided by the single battery 380, and can even be sized to provide more power storage capacity. For example, if the original battery has a capacity of 80 mAh, then the two smaller batteries can each have a 40 mAh capacity. Other power source allocations are possible as well, and might be better suited depending on the overall design. To take just one of many possible examples, one of the batteries can have a capacity of 30 mAh and the other can have a 50 mAh capacity if one ear piece needs more space for additional components (for example sensors) than the other. In one alternative, the placement of the two batteries is such that one battery is located in one of the ear pieces 21 or 22 and the other battery is located in the control box 28.

In yet other alternatives, more than two batteries can be used, such as but not limited to a third battery located in the control box 28 in addition to the two batteries in the ear pieces. By providing total battery functionality in the form of a plurality of distinct physical batteries, a smaller overall form factor can be obtained. Alternatively, by using a plurality of distinct physical batteries, the overall power capacity can be bigger, while maintaining an acceptably small size of the individual elements that the physical batteries are placed in. For example, a headset containing two batteries of 60 mAh each in each ear piece is more attractive than a headset containing a single battery of 80 mAh in a single ear piece. In the first option, the ear pieces can be smaller, yet the overall power capacity has increased. Ear pieces usually have a round form factor which is also the form factor that gives the highest energy density for batteries.

From an electrical point of view, the batteries are connected in parallel. This has the advantage of allowing an easy recharge mechanism because only a single recharging point is required. However, parallel connection of the batteries is not an essential aspect of the invention. In alternative embodiments, the batteries could be connected in series. In still other alternatives, the batteries need not be coupled to one another, but instead are each arranged to supply power to a corresponding distinct partition of circuitry within the headset. In this latter alternative, two separate charging points would be needed, but this may not be a problem when wireless charging is applied.

The batteries provide power to the circuitry in the control box 28. Control box 28 contains all active components: the radio unit 330 (containing the radio transceiver 331, the host processor 332, and in some embodiments also the FM radio 333), the codec 340 (containing the A/D converter 342 and D/A converters 341*a*, 341*b*), and the PMU 350. Since, in this particular embodiment, the control box 28 does not contain a battery, its size can be very small, which enhances the wearability of the headset 400. The control box 28 may, in some alternative embodiments, also contain a microphone 362 for voice communications. To control the headset 400, button switching devices ("buttons") can be placed either in the control box 28 (not shown) or on the ear pieces 21, 22 (not shown). Buttons can be used to turn the wireless headset on and off, for volume control, for play-next-skip tracks, and so on. Instead of buttons, a touch sensitive user interface (UI) may be applied (not shown). Furthermore, in some embodiments, control box 28 may include a display (not shown) to show headset status, caller ID, track ID, and the like.

The cables 23 and 24 contain a number of wires that carry power supply and signals. In this first exemplary embodiment, the total number of wires is limited to only four (4) wires per cable 23, 24: a positive battery wire (375), a negative battery wire (ground), an analog signal line for the speaker (373*a*/373*b*), and an analog ground for the speaker. The inventors recognize that in alternative embodiments, the number of wires per cable can be reduced to 3 having the analog ground for the speaker being shared with the battery ground. This alternative embodiment has a detriment, however, in that the battery ground has too much series resistance. Consequently, glitches caused by the radio/electronic circuit would be noticeable in the audio signal. The 4 wire embodiments avoid this problem.

One or more of the wires in cable 24 will also act as the antenna 391 for the Bluetooth® radio. For optimal transmission and reception, the length L24 of cable 24 is optimized for radio communications at 2.4 GHz. One or more wires in cables 23 and 24 combined (e.g., by means of capacitive coupling) will act as the antenna 392 for the FM radio. Where the length of the cable 23 is denoted L23, the total length L24+L23 of cables 24 and 23 is optimized for FM radio reception around 100 MHz. For a proper use of the microphone 362 in the control box 28 (i.e., to ensure placement of the microphone near the user's mouth), and for proper FM reception and Bluetooth® communications, L23>L24. Proper electrical decoupling between the wires in cable 23 and the wires in cable 24 is required to obtain sufficient antenna efficiency at RF frequencies (i.e., the cables 23 and 24 are isolated from one another with respect to radiofrequency signals). Furthermore, impedance matching is needed where the wires connect into the control box 28 in order to achieve a proper separation between the RF signals on the one hand and the analog and power supply signals on the other hand.

Figure 5:
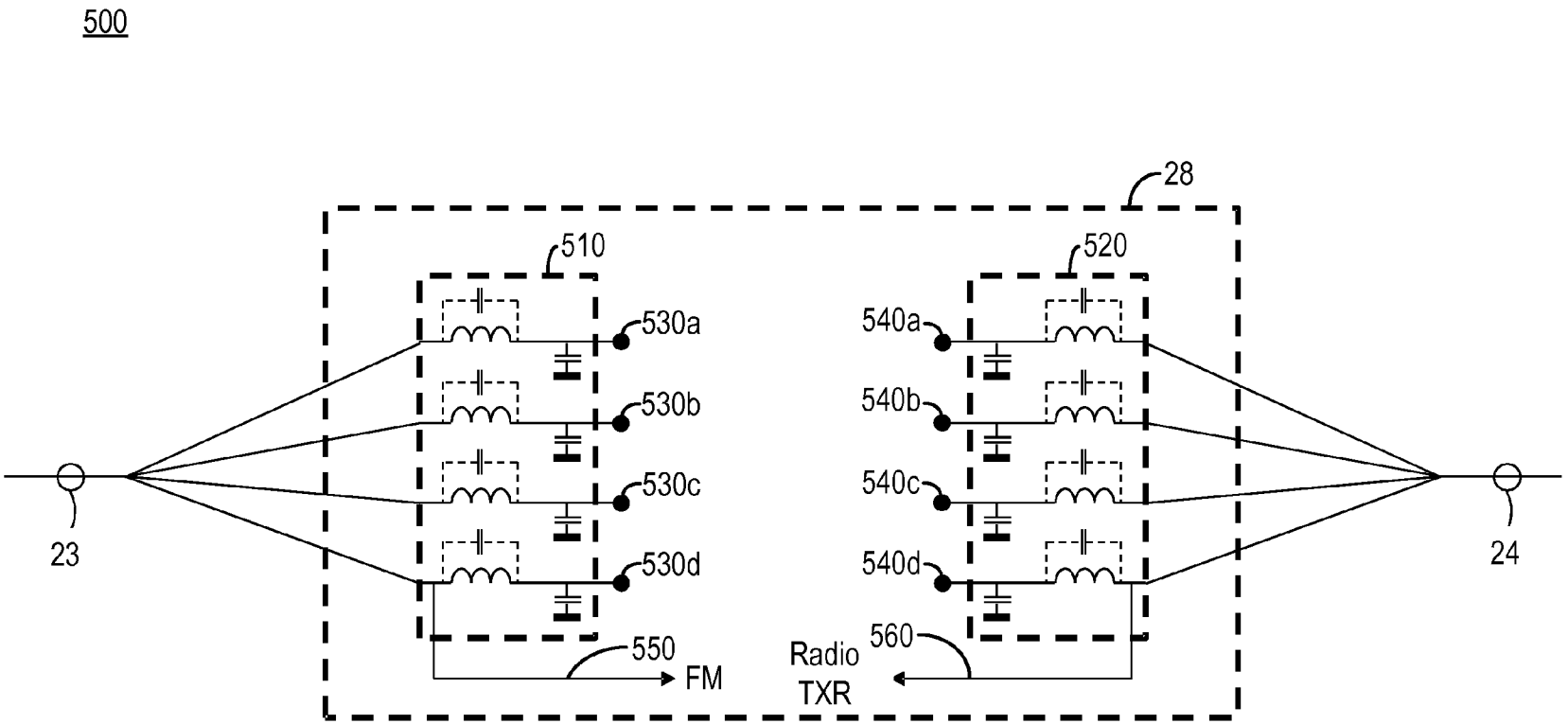
FIG. 5 is a schematic diagram illustrating an exemplary embodiment of a decoupling mechanism that can be employed in embodiments consistent with the invention.

An exemplary embodiment of the decoupling is depicted in the schematic diagram of FIG. 5. A dipole antenna is constructed for both the FM radio and the Radio Transceiver 330 (e.g., a radio transceiver operating at 2.4 GHz). The right cable 23 is one side of the dipole. A bank of notch filters 510 is embedded in the control box 28 to suppress the FM signals picked up by the right cable 23. (Note that the 2.4 GHz signals can freely pass through this notch filter bank 510).) The notch filter bank 510 provides a barrier for the FM signals (around 100 MHz). The outputs of the notch filters 530*a-d* are practically grounded for the FM signals (e.g., the ground of the printed circuit board in the control box 28). The notch filters could be implemented by a combination of a high-pass filter and a low-pass filter.

A similar notch filter construction 520 is placed on the left cable 24, but now the notch frequency is tuned to the band of the radio transceiver (e.g., 2.4 GHz), so that the radio transceiver radio signal is suppressed but the FM signal is able to freely pass through. It is now understood that between node 550 and any node 530*a-d* or 540*a-d* (which are all ground), the FM signal can be derived. The FM antenna is practically a dipole antenna with the right cable 23 being one part of the antenna and the left cable 24 being another part of the antenna.

Figure 6:
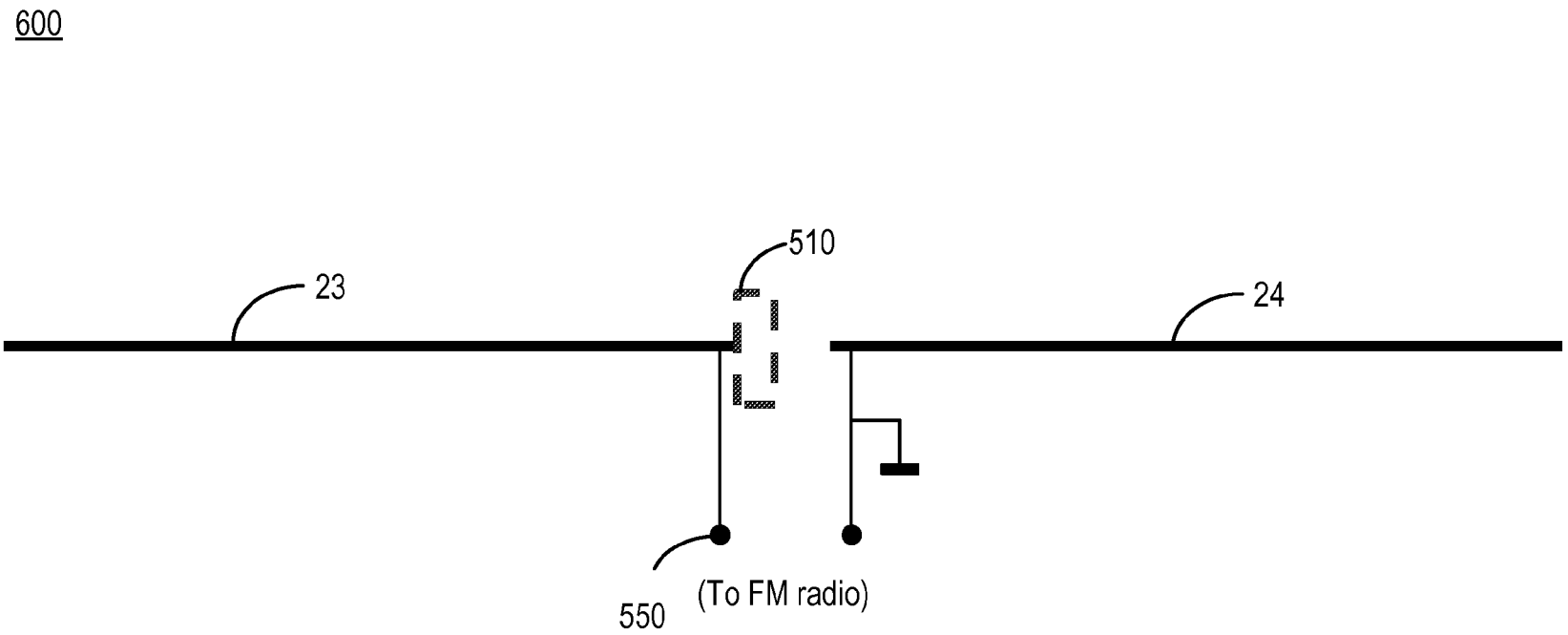
FIG. 6 is a schematic diagram illustrating the construction of a dipole antenna within a headset.
Figure 7:
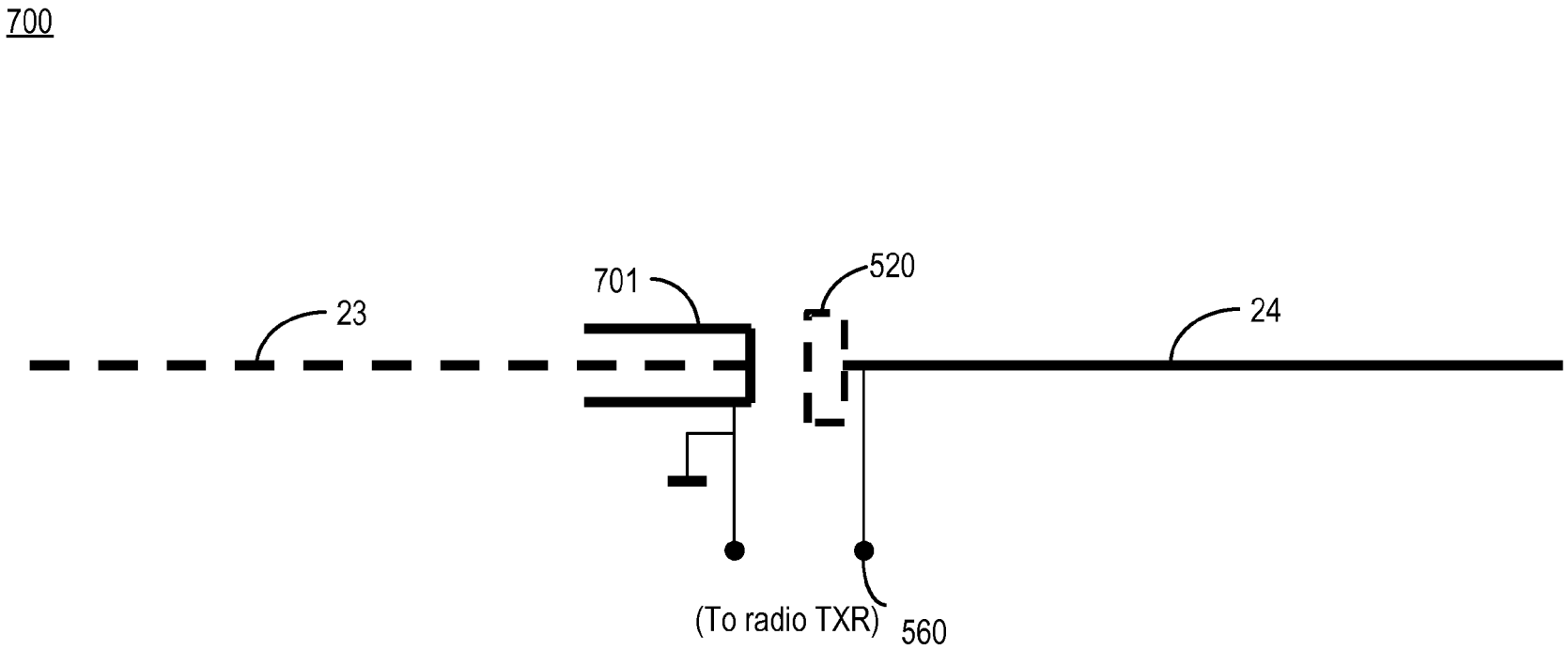
FIG. 7 is illustrates an exemplary embodiment of a decoupler sleeve that can be employed in embodiments consistent with the invention.

FIG. 6 is another schematic diagram illustrating this feature. This figure exemplifies the electrical schematics at FM frequencies (e.g., notch filter construction 520 is an electrical short-circuit for FM frequencies and is therefore not shown in FIG. 6). A similar situation is achieved for the radio transceiver's antenna (e.g., 2.4 GHz transceiver antenna). The radio transceiver's signal (e.g., 2.4 GHz signal) is present between the node 560 and any of the nodes 530*a*-3 or 540*a-d*. However, for optimal reception, the length of the right cable 23 is too long for the radio transceiver's (e.g., 2.4 GHz) signals. Therefore, a decoupler sleeve construction 701 is used as shown in FIG. 7. A sleeve 701 (e.g., made out of metal) constructed by the casing of the control box 28. This sleeve itself is grounded. The sleeve results in a high-impedance point on one side (e.g., on the left part of the sleeve). It therefore cancels the effect of the right cable 23 for the radio TXR signals (e.g., 2.4 GHz signals). Instead, the casing itself (sleeve) is used as one part of the dipole antenna (the casing can also be regarded as the ground plane of the antenna), while the left cable 24 is the other part of the dipole antenna. FIG. 7 exemplifies the electrical schematics at 2.4 GHz frequencies (e.g., notch filter construction 510 is an electrical short-circuit for 2.4 GHz frequencies and is therefore not shown in FIG. 7.)

The notch filter bandwidth of notch filter bank 510 is relatively wide and spans more than only the FM band ranging from 76 to 108 MHz. Therefore, in addition to suppressing FM signals, the notch filter bank 510 will also suppress signals in the high frequency (HF) and ultra-high frequency (UHF) bands. As a result, the electromagnetic compatibility (EMC) requirements on the electronic circuitry in box 28 are relaxed.

Since the FM antenna is embedded in the cable connecting the ear pieces 21, 22, and the control box 28, a predictable and relatively constant FM performance is experienced.

The wire 375 that provides the power from the batteries in the ear pieces 21 and 22 to the electronics in control box 28 is connected to the PMU 350. Via the wire 375, the two batteries are connected in parallel.

In yet other alternative embodiments, the number of wires in the cables 23, 24 can be further reduced. This can be achieved by replacing the signal wires carrying the analog signals to the speakers 361*a* and 361*b* by a single wire carrying digital signals. This requires more electronic circuitry in the ear pieces as is shown in the exemplary headset 800 depicted in FIG. 8. We now have a positive battery wire (375), a negative battery wire (ground), and a digital signal wire 820 (not shown). The negative battery wire will serve both for the power supply ground as well as for the digital signaling ground. A modem 810 is used to transfer the PCM audio data and control signaling information over the signal line 820. The modem could for example apply Bluetooth® baseband modulation. Note that codec functionality (i.e. the D/A converters and the filtering) has been divided up into two codecs 340*a*, 340*b*, one in each of the ear pieces 21, 22. Another codec function (A/D and filtering) is still provided as the codec 340*c* in the control box 28 to support the microphone functionality (Assuming that the headset is configured to provide for microphone functionality, which is not necessarily the case in all embodiments). In addition, PMUs 350*a*, 350*b*, and 350*c* are required in respective ones of the ear pieces 21, 22 as well as in the control box 28 to provide stable voltages to the codecs and modems. In the control box 28, two separate modems 810*c*, 810*d* for right and left are shown. However, in alternative embodiments a single modem may suffice since right and left information can be included in a single payload; alternatively, a time multiplexing method can be applied to separate the left and right signals. In yet other alternative embodiments, no separate signal wire is used, but the digital signals are multiplexed on the positive battery wire 375 (with a single wire serving as both the digital signal ground and the power supply ground). In such embodiments, decoupling circuitry is needed to separate the DC power supply path from the digital signals.

In still other embodiments consistent with the invention, only a single wire is used for each ear piece. The wire serves only to provide antenna functionality for FM reception and communications between the headset 16 and the host device 12. In this case, each of the elements (i.e., the two ear pieces 21, 22 and the control box 28) is provided with its own power supply (i.e., a battery). Signaling between elements can be provided optically (e.g., using an optical fiber between the control box and the ear pieces) or wirelessly. In the latter case, capacitive coupling or a short-range radio could be used.

To further enhance user satisfaction with the headset, an easy-to-use method for recharging the batteries is desired. In some embodiments, this is achieved by placing connectors for recharging in either the right or left ear pieces 21, 22. Alternatively, connectors for recharging can be placed in the control box 28. In yet other alternatives, a wireless charging mechanism is applied, either at one or both ear pieces 21, 22; at the control box 28; or in one or both cables 23, 24. The batteries 381*a*, 381*b* are preferably connected in parallel (for the DC path) such that a single wired or wireless recharging point suffices.

In yet other aspects of embodiments consistent with the invention, noise cancellation and noise suppression can be supported by placing additional microphones in the ear pieces 21 and 22 (not shown). The additional microphones can be positioned on the ear piece part that is located within the ear canal and/or can be positioned on the ear piece part that is located outside the ear. When in-ear positioning is employed, the microphones can be used for near-end noise cancellation (so called because it benefits the user of the headset itself), that is, reducing the impact of environmental noise on the audio heard by the user. The audio (music) played in the ear is picked up by the microphones and compared to the music provided to the speaker. Any deviation is deemed to be noise that can be cancelled by using known noise cancellation techniques that rely on this feedback to adjust the signal supplied to the speaker. The audio processing for noise cancellation may be performed in the digital domain in a Digital Signal Processor (DSP) in control box 28. This DSP may, for example, be located in the host processor 332. Alternatively, the noise cancellation may be performed in the analog domain, for example in an analog circuit embedded in codec 340. Additional wires would be needed in cables 23 and 24 to carry the microphone signals to control box 28. Alternatively, these signals are multiplexed over a shared wire as was discussed in the embodiment shown in FIG. 8.

The in-ear microphones can also be used for voice pick-up. Far-end noise suppression (so-called because it benefits the user on the other side of the line, not the wearer of the headset, by reducing the impact of environmental noise on the voice) is achieved by the isolation of the ear canal itself: the ear bud pushed inside the ear canal prevents environmental noise from reaching the in-ear microphone. Special attention is required for echo cancellation when in-ear microphones are used.

Noise suppression and noise cancellation can also be achieved with microphones positioned on the ear piece part that is located outside the ear. For near-end noise cancellation, feed-forward techniques can be used.

For noise suppression, beam-forming can be used. In case of beam-forming, the information picked up by the right and left microphones needs to be combined. The concepts of noise cancellation and noise suppression can be implemented both in the embodiment of FIG. 4 as well as in the embodiment of FIG. 8. These kinds of audio processing functions are typically carried out by a digital signal processor (DSP). The DSP can be part of the host processor 332 in the control box 28 or in the configuration of FIG. 4. In alternative embodiments like FIG. 8, separate DSPs can be embedded in the ear pieces 21 and 22.

For beam-forming with external MICs, the information of both MICs needs to be combined. The signals from the MICs therefore need to be fed to a central unit (e.g., control box 28) so they can be combined. This would require additional wires in the configuration of FIG. 4.

Figure 8:
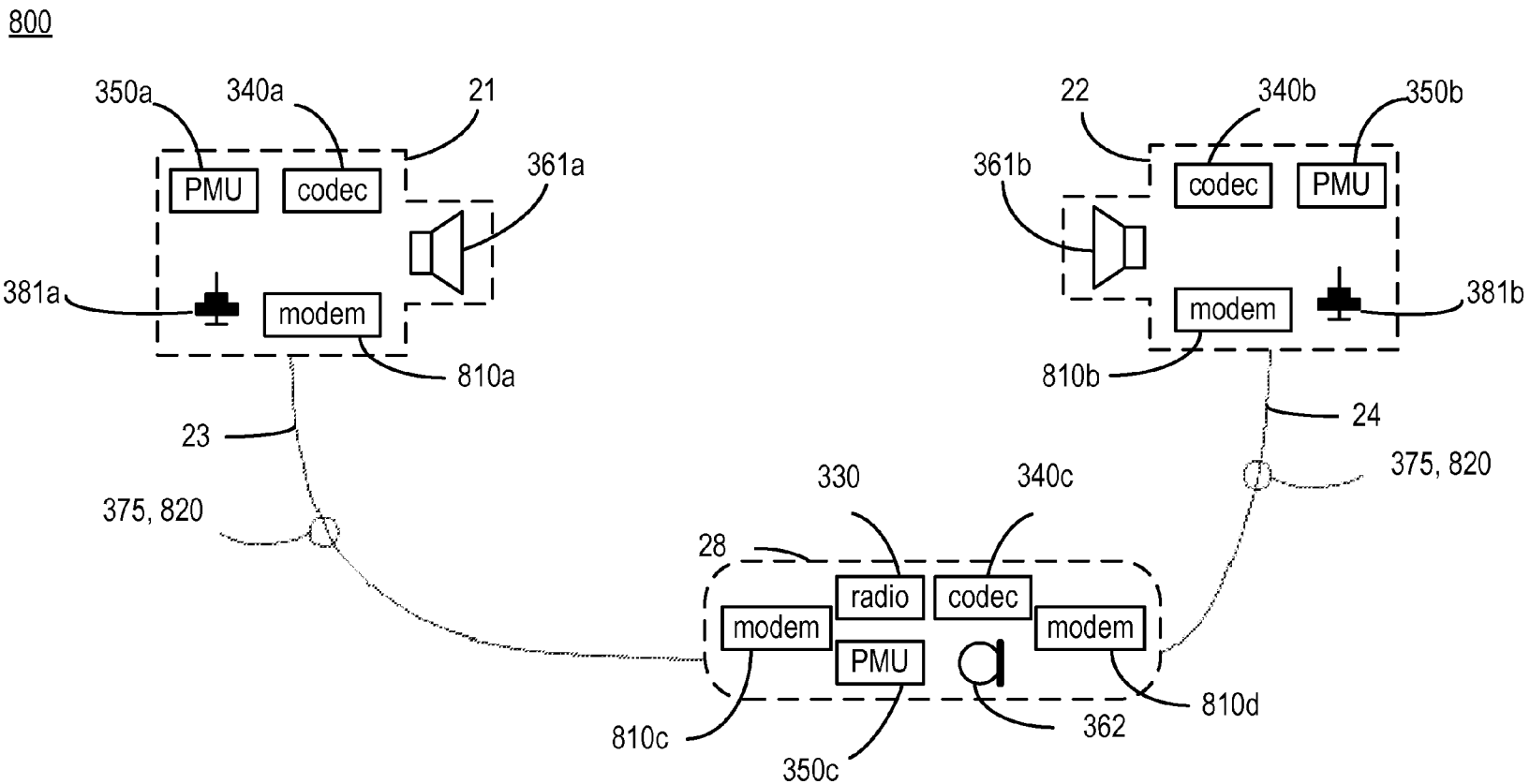
FIG. 8 is a detailed schematic diagram of a second embodiment consistent with aspects of the invention.

Since the timing information (phase) in the right and left MIC is critical, additional wires will be needed in cables 23 and 24 to support beam-forming in the embodiment of FIG. 4. No additional wires are needed in the embodiment of FIG. 8, provided the microphones use a shared clock to sample the audio. The modems in such embodiments support bi-directional communications, for example by applying time-division multiplexing.

Figure 9:
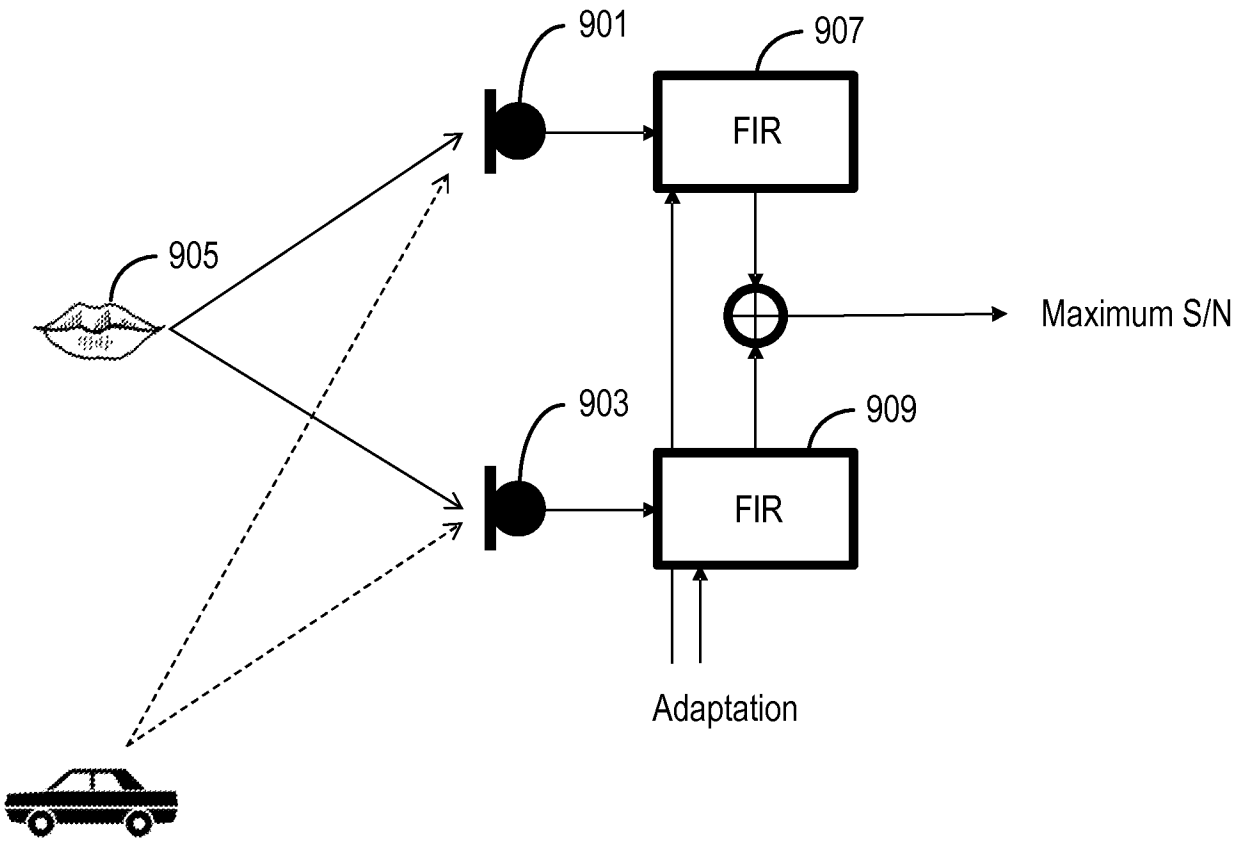
FIG. 9 illustrates beamforming concepts that can be employed in embodiments consistent with the invention.

The discussion will now focus on noise suppression techniques. Noise suppression in (wireless) headsets uses two (or more) microphones. With two microphones, beam forming can be applied. FIG. 9 illustrates beam forming concepts. The signals arriving at the microphones 901, 903 are correlated. Knowledge of the phase difference between the signals originating from the same source and arriving at the microphones 901, 903 allows the signals to be combined constructively using audio filters in a processing unit. All other signals can be combined destructively so that they are suppressed as much as possible. This achieves a high differentiation between the desired signal and the undesired signals.

The direction of the desired source (e.g., speech source 905) needs to be known in order to get the proper phase relationships. Therefore, the source needs to be identified. To achieve this, the noise-suppression algorithm is configured to include a speech detection algorithm that identifies speech. When speech is detected, an adaptation algorithm is invoked to determine the phase relation for the voice source. This phase relation is then used to enhance the voice signal in the received signals from both microphones 901, 903. The noise suppression algorithm has a presetting based on the position of the microphones 901, 903 (at the two ears in the case of the wireless headset) and the mouth. The algorithm tries to find the optimum spot of the mouth within a cone-shaped volume of space.

Each of two finite impulse response (FIR) filters 907, 909 receives signals from a respective one of the two microphones 901, 903. The FIR filters 907, 909 filter the microphone signals and provide the proper phase relationships. The FIR filter coefficients are variable. The coefficients determine both the amplitude and the phase response. An adaptive algorithm varies the coefficients such that a maximal signal-to-noise (S/N) (or signal-to-interference, S/I) ratio is achieved.

In an alternative embodiment, the parameter settings of the FIR filters 907, 909 are not variable but fixed. Since the two microphones have predefined positions (one microphone at each ear position), the relative location of the mouth can be predicted. Based on this prediction, fixed parameters can be determined which are programmed in the FIR filters. This is also called Blind Source Separation (BSS).

In the embodiments shown, the length of cable 24 connected to the left ear piece 22 is shorter than the length of cable 23 connected to the right ear piece 21. This is the preferred embodiment for right-handed users. For left-handed users, the situation may be just the opposite. The concepts described in this disclosure are applicable to any of these embodiments.

In addition to audio functionality, the headsets shown may also include sensing capabilities. For example, the microphones placed in the ear pieces for noise cancellation may also be used for the pickup of bio-signals such as, but not limited to, heart rate or breathing rate. These signals may be forwarded from the ear pieces to the control box 28. The bio-signals can be processed by electronic circuitry in the control box 28 and/or can be communicated wirelessly from the headset to an external host device (e.g., a mobile phone or a personal computer) for processing.

Figure 10:
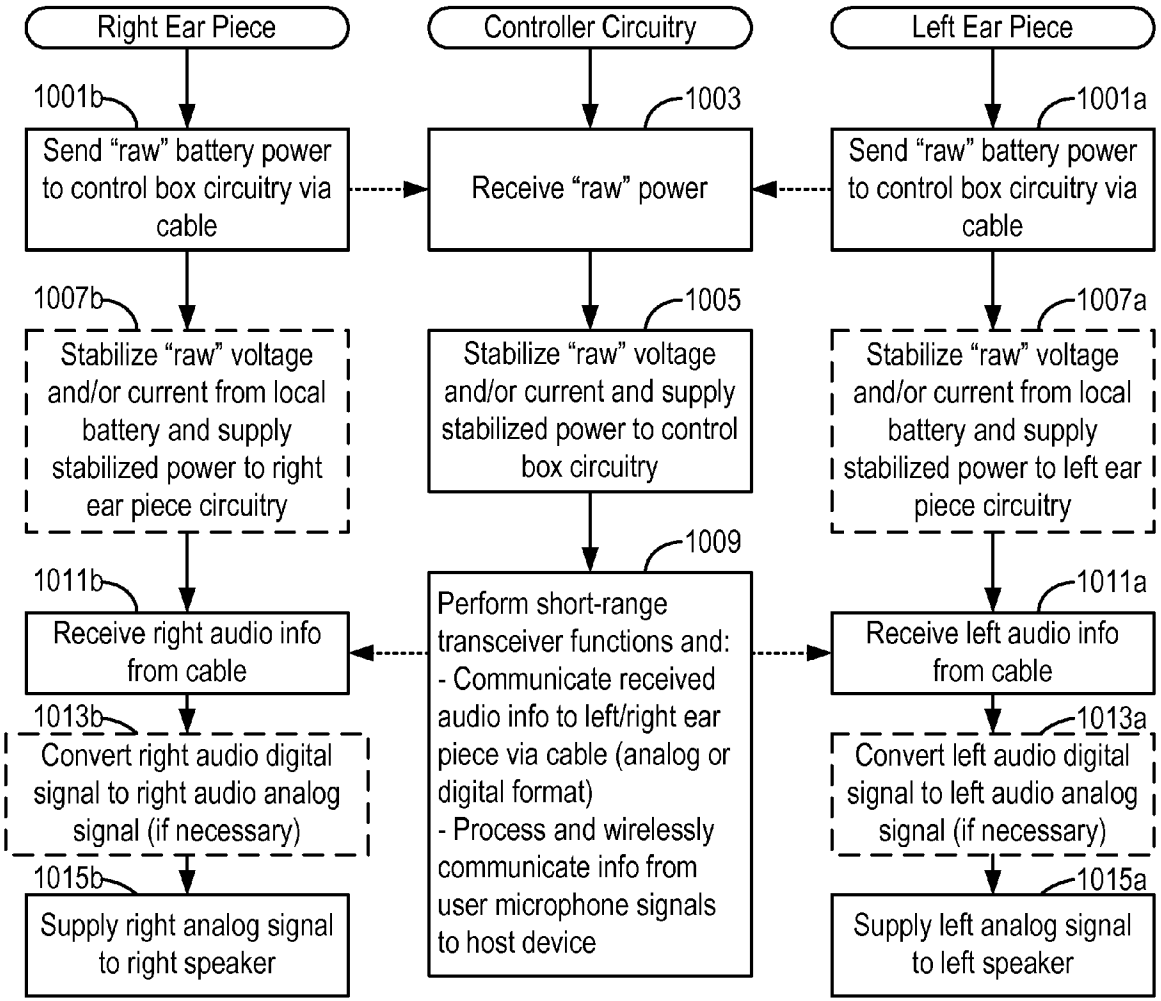
FIG. 10 is, in one respect, a flow diagram of steps/processes performed in accordance with one or more methods consistent with the invention.

FIG. 10 will now be described which is, in one respect, a flow diagram of steps/processes performed in accordance with one or more methods consistent with the invention. In another respect, FIG. 10 can be considered to schematically depict device circuitry 1000 comprising the illustrated functionally described components (i.e., means for performing the described functions).

To facilitate the reader's understanding, FIG. 10 is divided into three columns, with each individual column representing steps/processes/means all associated with a single one of three distinct entities: the right ear piece 21, the control box 28, and the left ear piece 22. The description begins with the mechanism by which all of the device circuitry 1000 is powered. As mentioned earlier, each of the ear pieces 21, 22 includes a battery 381*a*, 381*b*. These batteries supply unregulated power (referred to herein as "raw" power). Each of the batteries 381*a*, 381*b* sends its raw power to the control box circuitry via a respective one of the cables 23, 24 (steps 1001*a*, 1001*b*). The control box circuitry (e.g., the PMU 350 or 350*c*) receives the raw power (step 1003), stabilizes the received voltage and/or current and supplies the stabilized voltage and/or current to control box circuitry (step 1005).

In some (but not necessarily all) embodiments, such as the embodiment depicted in FIG. 8, each of the ear pieces 21, 22 includes active circuitry that requires power. In such embodiments, each of the batteries 381*a*, 381*b* also supplies its power to a respective one of the local PMUs 350*a*, 350*b* (i.e., local to the ear piece), in which case each of the right and left ear pieces 21, 22 stabilizes its local raw voltage and/or current and supplies the stabilized power to its own local circuitry (step 1007*a*, 1007*b*).

The control box circuitry also performs short-range transceiver functions (step 1009), including:

- communicating received audio information to the respective right and left ear pieces 21, 22 via the cable; and
- processing and wirelessly communicating information from the microphone signals (e.g., generated by the microphone 362) to the host device 12.

Each of the ear pieces 21, 22 receives its audio information from a respective one of the cables 23, 24. As mentioned earlier, different embodiments can employ these cables in different ways to communicate audio information from the control box circuitry to one of the ear pieces 21, 22. In some embodiments, analog signals are used and in others, digital signaling is used. In case of the latter, the left and right ear piece circuitry each further performs converting its respective left/right audio digital signal into a respective left/right audio analog signal (step 1013*a*, 1013*b*).

Regardless of whether analog or digital signaling is used along the cables, a left and right analog signals are supplied to respective ones of the left and right speakers 361*b*, 361*a* (step 1015*a*, 1015*b*).

It will be appreciated that in various alternative embodiments, device circuitry can perform additional steps as well, such as those involved in receiving signals from the extra noise cancellation/suppression microphones (mentioned earlier) and processing those signals to cancel/suppress noise from an audio signal to be generated by one or both of the left and right speakers 361*b*, 361*a*.

The invention has been described with reference to particular embodiments. However, it will be readily apparent to those skilled in the art that it is possible to embody the invention in specific forms other than those of the embodiment described above.

For example, in exemplary embodiments described above, various functionalities have been attributed to a "left" ear piece or to a "right" ear piece. However, it will be readily apparent that a wireless headset consistent with one or more inventive principles as set forth herein can be implemented with the roles of the left and right ear pieces (and their associated functions) being reversed. Hence, it is equally valid to describe various embodiments more generally in terms of "first" and "second" ear pieces, wherein the "first" ear piece can refer to either the left ear piece or the right ear piece, and the "second" ear piece consequently refers to the other one of the left and right ear pieces.

The described embodiments are therefore merely illustrative and should not be considered restrictive in any way. The scope of the invention is given by the appended claims, rather than the preceding description, and all variations and equivalents which fall within the range of the claims are intended to be embraced therein.

What is claimed is:

1. A wireless headset device comprising:

a first ear piece comprising a first speaker;

a second ear piece comprising a second speaker;

a control box comprising control box circuitry, wherein the control box is separate from the first and second ear pieces;

a first cable connected at one end to the first ear piece and connected at another end to the control box; and a second cable connected at one end to the second ear piece and connected at another end to the control box, wherein:

the control box circuitry comprises a short-range radio transceiver, a codec, and a power management unit; and the first ear piece further comprises a first battery connected to supply power to the power management unit by means of the first cable, wherein:

the second ear piece further comprises a second battery connected to supply power to the power management unit by means of the second cable; and the batteries in the first and second ear pieces are electrically connected in parallel.

2. The device of claim 1, wherein the control box comprises a third battery connected to supply power to at least a portion of circuitry within the wireless headset device.

3. The device of claim 1, wherein the first ear piece is a left ear piece.

4. The device of claim 1, wherein the control box circuitry comprises an FM radio.

5. The device of claim 4, wherein the first and second cables are configured to be used together as an antenna for the FM radio.

6. The device of claim 5, wherein the combined length of the first and second cables is optimized for reception of FM radio signals at approximately 100 MHz.

7. The device of claim 5, wherein the first and second cables are isolated from one another with respect to radiofrequency signals.

8. The device of claim 1, wherein the control box comprises a microphone configured to supply microphone output signals to the codec.

9. The device of claim 8, wherein output signals from the codec are supplied to the short-range radio transceiver, the short-range radio transceiver being configured to wirelessly communicate information contained in the codec output signals to a host device.

10. The device of claim 1, wherein one of the first and second cables is configured for use as an antenna for the short-range radio transceiver.

11. The device of claim 1, wherein one of the first and second cables is configured for use as a first part of the antenna for the short-range radio transceiver, and the control box includes a casing that forms a second part of the antenna for the short-range radio transceiver.

12. The device of claim 10, wherein the length of the cable that is configured for use as the antenna for the short-range radio transceiver is optimized for transmission and reception of radio signals at 2.4 GHz.

13. The device of claim 1, wherein:

the first cable comprises two wires coupled to convey power from the first battery to the power management unit; and the first cable comprises an additional two wires coupled to carry analog audio signals between the first speaker and the control box circuitry.

14. The device of claim 13, wherein:

the second ear piece further comprises a second battery connected to supply power to the power management unit by means of the second cable;

the second cable comprises two wires coupled to convey power from the second battery to the power management unit; and the second cable comprises an additional two wires coupled to carry analog audio signals between the second speaker and the control box circuitry.

15. The device of claim 1, wherein:

the first cable comprises two wires for supplying the power from the first battery to the power management unit; and the device comprises circuitry for communicating a first channel of two-channel audio information in digital form from the control box circuitry to circuitry in the first ear piece via the two wires in the first cable.

16. The device of claim 15, wherein:

the second ear piece further comprises a second battery connected to supply power to the power management unit by means of the second cable;

the second cable comprises two wires for supplying the power from the second battery to the power management unit; and the device comprises circuitry for communicating a second channel of the two-channel audio information in digital form from the control box circuitry to circuitry in the second ear piece via the two wires in the second cable.

17. The device of claim 16, wherein:

the first and second channels of the two-channel audio information are time multiplexed when communicated via the first and second cables to the respective first and second ear pieces.

18. The device of claim 1, wherein one or both of the first and second ear pieces includes a noise cancellation/suppression microphone; and the device comprises circuitry coupled to receive signals from said one or both of the noise cancellation/suppression microphones and is configured to cancel/suppress noise from an audio signal to be generated by one or both of the first and second speakers.

19. The device of claim 1, comprising:

a first microphone for generating a first microphone signal from sensed acoustic energy;

a second microphone for generating a second microphone signal from sensed acoustic energy; and beamforming circuitry coupled to receive the first and second microphone signals and configured to constructively combine components of the first and second microphone signals that are associated with a source of acoustic energy, and to destructively combine all other components of the first and second microphone signals.

* * * * *

UNITED STATES PATENT AND TRADEMARK OFFICE

CERTIFICATE OF CORRECTION

PATENT NO. : 8,483,400 B2
APPLICATION NO. : 12/906968
DATED : July 9, 2013
INVENTOR(S) : Johannes Lucas Schreuder and Jan-Willem Zweers It is certified that error appears in the above-identified patent and that said Letters Patent is hereby corrected as shown below:

On the Title Page, Item (54) and in the Specification, Column 1, Lines 1-3, Title, please delete: "SMALL STEREO HEADSET HAVING SEPERATE CONTROL BOX AND WIRELESS CONNECTABILITY TO AUDIO SOURCE" and insert --SMALL STEREO HEADSET HAVING SEPARATE CONTROL BOX AND WIRELESS CONNECTABILITY TO AUDIO SOURCE--.

Signed and Sealed this
First Day of October, 2013

Teresa Stanek Rea
*Deputy Director of the United States Patent and Trademark Office*